United States Patent [19]

Chism

[11] 4,105,011

[45] Aug. 8, 1978

[54] ARCHERY BOWSTRING RELEASE

[76] Inventor: Van B. Chism, 1323 Hwy. 35, Benton, Ark. 72015

[21] Appl. No.: 836,179

[22] Filed: Sep. 23, 1977

[51] Int. Cl.[2] ..... F41B 5/00

[52] U.S. Cl. ..... 124/35 A; 24/132 WL; 24/230 AT

[58] Field of Search ..... 124/35 A, 23 R, 24 R, 124/90, 41 A; 24/132 WL, 132 R, 230 AT, 211 R; 128/346

[56] References Cited

U.S. PATENT DOCUMENTS

| | | | |
|---|---|---|---|
| 2,269,790 | 1/1942 | Sherrill | 24/132 R |
| 2,819,707 | 1/1958 | Kayfes et al. | 124/35 A |
| 2,936,749 | 5/1960 | Chellstorp | 124/35 A |
| 2,977,952 | 4/1961 | Gabriel et al. | 124/35 A |
| 3,437,370 | 4/1969 | Bochman et al. | 24/230 AT |
| 3,446,200 | 5/1969 | Gross | 124/35 A X |
| 3,585,692 | 6/1971 | Le Mire | 24/230 AT |
| 3,952,382 | 4/1976 | Vaage | 24/230 AT X |

*Primary Examiner*—Richard C. Pinkham
*Assistant Examiner*—William R. Browne
*Attorney, Agent, or Firm*—Ralph R. Pittman

[57] ABSTRACT

A hand-held, thumb operated archery bowstring released has a generally lazy-T-shaped body member contoured as a handhold. A pair of forwardly projecting jaw members retain a tensioned bowstring until released by a single slight downward movement of an associated plunger. Following such release an open helical compression spring acting on the plunger resets the jaw members to the bowstring holding position. To enable a high degree of target accuracy during the use of the invention, the structural members are disposed symmetrically about a vertical plane through the axis of the plunger and the center line between the jaw members, and the small mechanical releasing movements occur along paths of similar symmetry. The plunger has a circular cross section and has a plurality of longitudinally spaced coaxially aligned and small diameter segments and an upstanding conical frustum segment.

10 Claims, 8 Drawing Figures

ARCHERY BOWSTRING RELEASE

BACKGROUND OF THE INVENTION

The invention is an accessory relating to the sport of archery, for use in facilitating the drawing and release of the bowstring of an archery bow.

Bowstring releases intended for so functioning have been described in numerous patents during the last 100 years, many depicting releases embodying a movable hook or a single movable jaw, along with certain others utilizing a scissor-pivoted or pincer type of jaw construction.

Plunger-triggered releases are also found in the prior art, commonly with unsymmetrical plungers, or if symmetrical, requiring more than one manual movement to release a drawn bowstring and reset the device.

For accurate shooting, the mechanical members of a bowstring release should be few in number and preferably arranged symmetrically about a vertical plane through the drawn bowstring. The body member on which the movable members are mounted should be adapted for use while held in a posture similar to the natural position of a bowman's hand absent the mechanical release, and the release of the drawn and retained bowstring should be effected with the smallest possible manual movement.

SUMMARY OF THE INVENTION

The bowstring release described herein, while utilizing a pair of pivoted jaw members for holding and releasing the bowstring, avoids the usual scissors or pincer type of pivotal structure by incorporating a construction in which the shiftable jaw members do not intersect at the pivotal mounting.

The structure is completely free of dissymmetry about a vertical plane passing through the interfacial plane of the abutting jaw members and the longitudinal axis of the plunger, and the latter is in a symmetrical shape formed by a surface of revolution. The plunger is continually biased to the jaw-closed position by means of a holding compression helical spring urging the plunger upwardly from the bottom of the plunger-containing bore in which the plunger is slidably fitted.

A detent limits the upward movement of the plunger to a predetermined degree, such that only a small downward axial movement of the plunger is required to release a drawn bowstring from the jaw members. The forward surface of the body member is contoured for convenient grasping by the fingers of an archer's hand, and an upper projecting portion of the plunger is readily available for a slight depression by the thumb of the archer to actuate the jaw members to the open position.

DESCRIPTION OF THE PREFERRED EMBODIMENT

Figure 1:
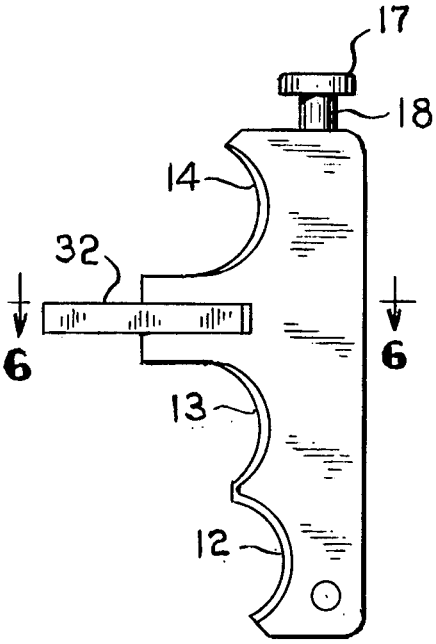
FIG. 1 is a side elevational view of the invention.
Figure 2:
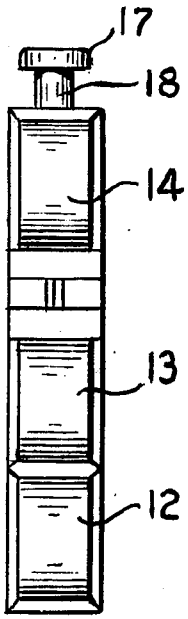
FIG. 2 is a front elevational view of the invention.
Figure 3:
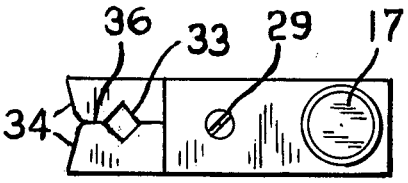
FIG. 3 is a plan view of the invention.

The external appearance of the bowstring release of the invention is illustrated at approximately full size at FIGS. 1, 2 and 3; the illustrations at FIGS. 5, 6, 7 and 8 are about twice actual size for the purpose of clarity.

Figure 5:
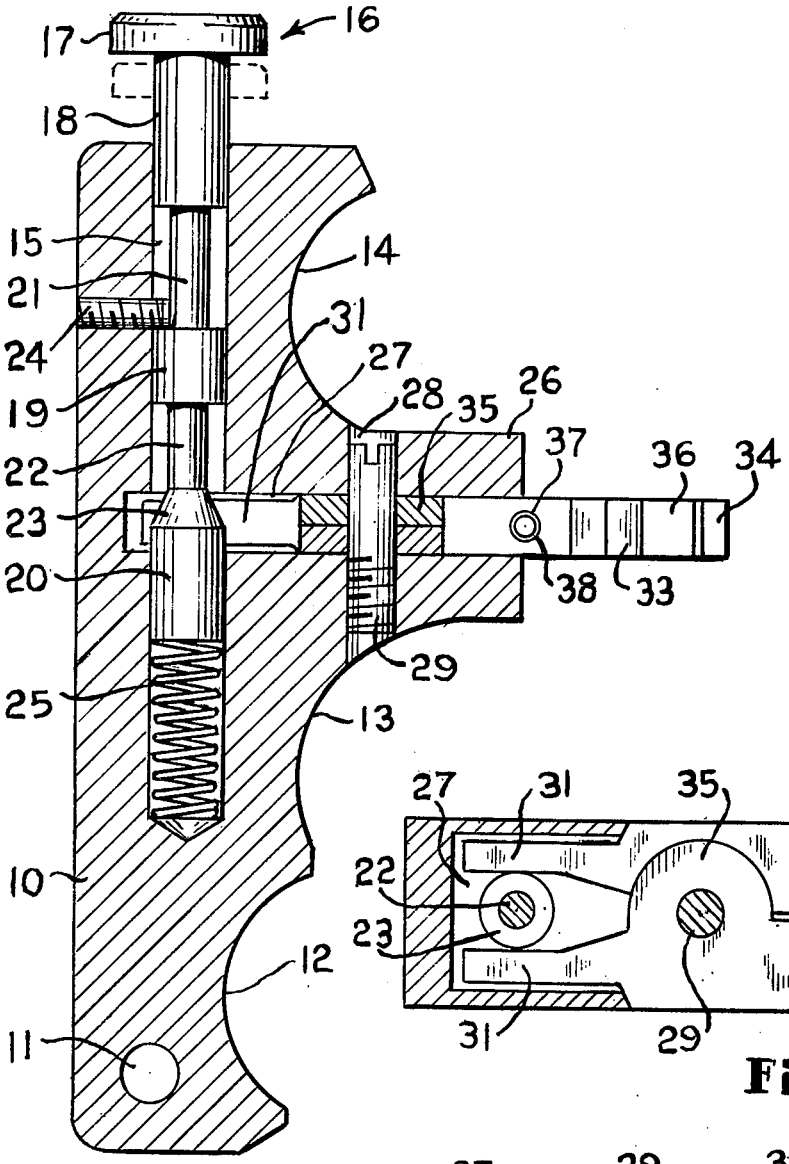
FIG. 5 is a vertical sectional view of the invention, drawn to an enlarged scale to more clearly show the structural members and their relationship.
Figure 6:
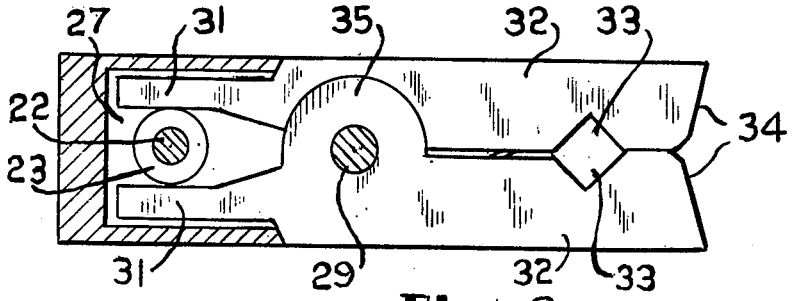
FIG. 6 is an enlarged sectional view, taken along the line 6 — 6 of FIG. 1, showing the jaw members locked in the closed position.

Referring first to the sectional view shown in FIG. 5, the hand grip body member is shaped generally in the form of a lazy T, the longitudinally extending crossbar portion 10 being disposed in a vertical position and the intermediately located stem defining a forwardly projecting portion 26. To facilitate hand gripping of the body portion, a rearwardly curved index finger-receiving depression 14 is contoured to merge with the upper surface of the forwardly projecting portion 26, and a series of ridges and depressions 12 and 13 are similarly formed to receive other fingers of an archer's hand. The bore 11 adjacent to the lower end of the body member is for the attachment of a carrying cord.

A blind cylindrical bore 15 extends downwardly into the top of the upright portion 10 to an elevation below its junction with the forwardly projecting portion 26, and the longitudinally extending plunger 16 is slidably fitted into the bore, a relatively short portion of the plunger projecting upwardly and outwardly therefrom. The shape of the plunger 16 is that of a surface of revolution about its longitudinal axis defining a series of seven coaxially extending, longitudinally spaced segments; viz, a first disk-shaped segment 17 having a diameter greater than that of the bore located at the outer end of the upwardly projecting portion, a second cylindrical segment 18 having an upper portion thereof extending above the upright portion and a lower portion slip-fitted into the bore, a third cylindrical segment 21 having a diameter substantially less than that of the second segment 18, a fourth cylindrical segment 19 having a diameter equal to that of the second segment 18, a fifth cylindrical segment 22 having a diameter equal to that of the third segment 21, a sixth conically tapered frustum 23 having top and base diameters equal respectively to those of the third segment 21 and the second segment 18 and a seventh cylindrical segment 20 equal in diameter to that of the second segment 18 and being the lower end portion of the plunger 16.

The lower end of the plunger 16 is positioned above the lower end of the bore 15, and a main holding open helical compression spring 25 is interposed therebetween, continuously urging the plunger 16 upwardly from the lower end of the bore 15.

The upward movement of the plunger 16 is limited by the engagement of a portion of the upper surface of the plunger segment 19 with the detent screw 24, the latter extending inwardly in threaded engagment with the wall of the upright portion 10 and therebeyond into the annular space between the plunger segment 21 and the inner surface of the bore 15.

Figure 8:
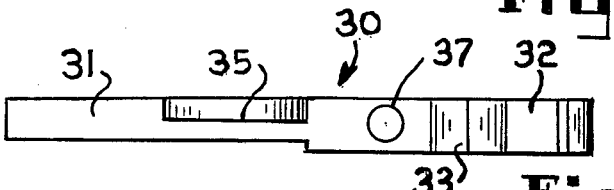
FIG. 8 is a side elevation of one of the pair of jaw members, particularly for illustrating the mating recessed portions through which the pivot of the pivotal jaw member mounting passes.

A cavity 27, in communication with the bore 15, extends forwardly therefrom through the forwardly projecting portion 26, the opposed upper and lower surfaces thereof defining vertically spaced planar surfaces which are coextensive with the similarly vertically spaced bifurcations forming the outer and forward end portions of the forwardly projecting body portion 26. A pair of jaw members 30, one of which is illustrated at FIG. 8, extend rearwardly within the cavity 27, being shiftably disposed between its vertically spaced upper and lower bounding surfaces.

As shown in FIGS. 5, 6, 7 and 8, each jaw member has a centrally located, transversely extending reduced thickness arcuate portion 35 disposed for slidable engagement with the like arcuate portion of another identical jaw member, the jaw members being pivotally mounted on the body member by the pivot screw 29, the latter extending downwardly into a lower threaded portion of the bore 28 in the forwardly projecting body portion 26 and through the mating central arcuate portions 35 of the jaw members.

When the plunger 16 is urged upwardly against the detent 24 the rearwardly extending portions 31 of the jaw members 30 engagingly straddle a portion of the lowest plunger segment 20. The jaw members 30 are pivotally mounted in non-intersecting relationship, contrary to a scissors type construction, the opening or spreading of the rearwardly extending portions 31 effecting the engagement of the mating faces 36 of the bowstring retaining portions 32 at the forward ends of the jaw members, thereby enabling a drawn bowstring to be securely held within the opening formed by the registering V-shaped notches 33. The inwardly sloping forward ends 34 (FIGS. 6 and 7) of the jaw members facilitate the passage of a bowstring between the forward engaging portions of the jaw members.

Figure 7:
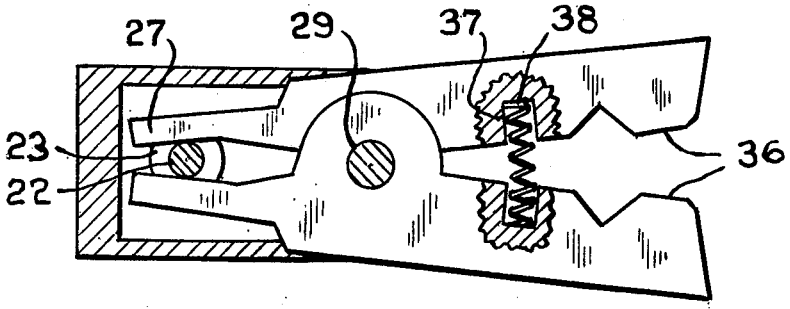
FIG. 7 is a similar view showing the jaw members opened following a downward movement of the plunger.

The open or alternate position of the jaw members shown at FIG. 7 results from the slight downward movement of the plunger, against the bias of the spring 25, which moves the conically tapered portion 23 downwardly beyond the rearwardly extending portions 31 of the jaw members. The bowstring retaining portions of the jaws are urged open by the pressure of the drawn bowstring along the forward converging surfaces of the V-shaped notches, aided further by an auxiliary compressed open helical spring 38, the latter extending into, and being retained by, a pair of opposed complementary blind holes 37 extending transversely from the adjacent inner surfaces of the jaws at a location forwardly beyond the pivotal mounting.

Figure 4:
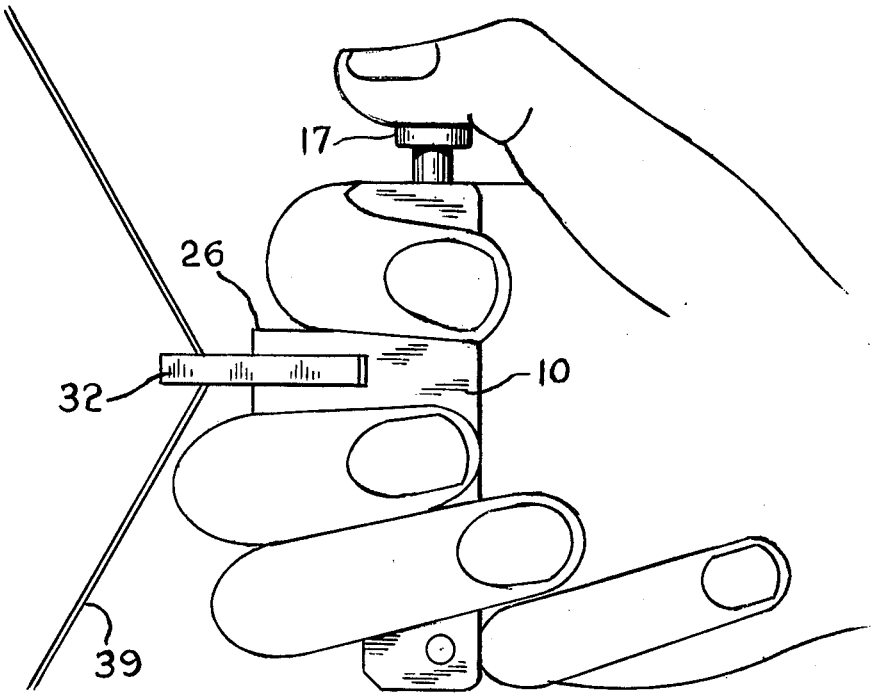
FIG. 4 illustrates the invention held by an archer, immediately before depressing the plunger to release a drawn bowstring.

The bowstring release held in the hand of an archer with a fragment of a tensioned bowstring 39 being retained prior to its release is illustrated at FIG. 4. A slight downward depression of the plunger moves its conically tapered segment 23 below the rearward jaw member portions 31 which were previously held apart by engagement with the lower large diameter plunger segment 20, freeing the portions 31 for equidistant inward swingable movement to engagement with the small diameter plunger segment 22 and concurrently moving the forward bowstring retaining portions of the jaw members to the open position. FIG. 7 shows the positions assumed by each of the jaw members during the release of a bowstring.

Immediately upon removal of downward pressure, the plunger springs back to the closed-jaw position; the operation of bowstring release requires only one small rectilinear plunger movement to either grasp a bowstring between, or release it from, the jaw members.

It is also noted that both the structure and the mechanical movements thereof are symmetrical about a vertical plane which includes the longitudinal axis of the plunger and the center line of the associated jaw members. This symmetrical construction, along with the slight and symmetrical operating motion, enable a bowman to attain a high degree of target accuracy by the use of the invention.

What is claimed is:

1. An archery bowstring release comprising:

a generally T-shaped body member positioned in a lazy T posture and including a longitudinally extending upright portion and a forwardly projecting portion extending perpendicularly therefrom at an elevation intermediate the ends of the upright portion;

a blind bore extending downward longitudinally from the upper end of said upright portion to an elevation below its junction with said projecting portion;

a slidable plunger slip-fitted into said bore, the lower end of said plunger being positioned below said junction and an upper end portion projecting upwardly above the upper end of said upright portion;

said plunger being of circular cross section and including a plurality of longitudinally spaced coaxially aligned large and small diameter cylindrical segments and a single upstanding conical frustum segment;

a cavity extending inwardly in communication with said bore from the forward end of said projecting portion and a pair of coextensive jaw members pivotally mounted intermediate their respective ends in non-intersecting relationship on said forwardly projecting portion;

said jaw members extending rearwardly into said cavity and having their rearward end portions straddling the large diameter plunger segment adjacent to the base of said conical segment and said jaw members extending forwardly beyond said body member and having therein a pair of opposed complementary bowstring retaining notches, the outer ends of said jaws abutting for retaining a bow string in said notches;

main spring means yieldably urging said plunger upwardly from the lower end of said bore and detent means fixed to said body member in the path of upward movement of said plunger;

auxiliary spring means biasing the foward portions of said jaw members apart and concurrently biasing the rearward portions of said jaw members about said pivotal mounting into engagement with said plunger;

a small diameter segment of said plunger being positioned adjacently above the plunger engaging portions of said jaw members, said last-named segment moving downwardly between the plunger engaging portions upon the occurrence of a downward movement of the upper projecting end portion of the plunger to release a bowstring from said bowstring retaining notches.

2. The bowstring release claimed in claim 1, wherein said conical frustum segment is interposed between the large diameter plunger segment straddled by said rearward end portions of said jaw members and the small diameter segment coextensive with the top of said conical frustum segment.

3. The bowstring release claimed in claim 1, wherein said auxiliary spring means comprises a compressed open helical spring located forwardly beyond the pivotal mounting of said jaw members and extending transversely therebetween, the end portions of said spring being disposed in a pair of opposed blind bores in said jaw members.

4. The bowstring release claimed in claim 1, in which said main spring means comprises a compressed open helical spring interposed between the inner end of said bore and the lower end of said plunger.

5. The bowstring release claimed in claim 1, wherein the upper and lower bounding surfaces of said inwardly extending cavity define vertically spaced planar surfaces between which said jaw members are shiftably movable.

6. The bowstring release claimed in claim 1, in which said jaw members are pivotally mounted on a pivot passing downwardly through a central arcuate portion of each jaw member, each said arcuate portion extending transversely in mating engagement with the arcuate portion of the other jaw member, the arcuate portion of each jaw member being arcuately recessed for receiving the other of said central arcuate portions in cooperating slidable engagement.

7. The bowstring release claimed in claim 1, in which the outer end portions of said jaw members lie in vertical intersecting planes, the intersection of said planes defining the line of abutment between said outer end portions.

8. The bowstring release claimed in claim 1, wherein the forward surface of said upright body portion located above and below said forwardly projecting portion is in the form of a series of alternate depressions and ridges, there being a single depression above said forwardly projecting portion and a plurality of depressions therebelow, said single depression being adapted to receive the index finger and said plurality of depressions being adapted to receive other fingers of the hand of a bowman.

9. The bowstring release claimed in claim 1, wherein said detent means projects transversely into an annular space defined by the wall of said bore and the small diameter segment of said plunger which extends longitudinally between two longitudinally spaced upper and lower large diameter segments, the lower large diameter segment engaging the detent to limit the upward travel of the upwardly biased plunger and the upper large diameter segment engaging the detent to limit the downward travel of the plunger into said bore.

10. In a bowstring release comprising a generally T-shaped body member having a blind bore extending longitudinally into a first portion of said member and a pair of jaw members reciprocably movable between open and closed positions pivotally mounted on a second portion of said body member, a slidable plunger extending into said bore, a manipulative portion of said plunger projecting outwardly from said bore and means operatively coupling said plunger to said jaw members for reciprocably actuating said jaw members between the open and closed positions upon the occurrence of predetermined longitudinal manual movements of said plunger into and out of a portion of said bore; the improvement wherein:

said plunger comprises seven integral longitudinally extending coaxially aligned segments defined by a surface of revolution;

said segments including a first disk-shaped segment positioned at the outwardly projecting end of said plunger, a second cylindrical segment slip-fitted into said bore, a third cylindrical segment having a diameter substantially less than that of said second second segment, a fourth cylindrical segment equal in diameter to that of said second segment, a fifth cylindrical segment equal in diameter to that of said third segment, a sixth conically tapered segment having top and base diameters equal respectively to those of said third and second segments and a seventh cylindrical segment equal in diameter to that of said second segment.

* * * * *